US006578672B1

(12) United States Patent
Miyoshi

(10) Patent No.: US 6,578,672 B1
(45) Date of Patent: Jun. 17, 2003

(54) DRIVING APPARATUS FOR ELEVATOR

(75) Inventor: Hiroyuki Miyoshi, Mie (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/585,147

(22) Filed: Jun. 1, 2000

(30) Foreign Application Priority Data

Jun. 2, 1999 (JP) ..... 11-154508

(51) Int. Cl.[7] ..... B66B 11/08

(52) U.S. Cl. ..... 187/254; 187/351; 254/363; 310/83

(58) Field of Search ..... 254/363; 187/254, 187/351; 310/83

(56) References Cited

U.S. PATENT DOCUMENTS

| | | | | | |
|---|---|---|---|---|---|
| 81,289 | A | * | 8/1868 | Reynolds | 254/363 |
| 230,613 | A | * | 8/1880 | Chapman | 254/363 |
| 1,898,753 | A | * | 2/1933 | Wente | 310/83 |
| 2,488,180 | A | * | 12/1949 | Evans | 254/363 |
| 4,328,954 | A | * | 5/1982 | Logus | 254/344 |
| 4,427,162 | A | * | 1/1984 | Noda | 242/241 |
| 4,461,460 | A | * | 7/1984 | Telford | 254/344 |
| 4,465,162 | A | * | 8/1984 | Yokota | 187/29 |
| 4,557,465 | A | * | 12/1985 | Lundberg | 254/287 |
| 5,010,981 | A | * | 4/1991 | Heikkinen | 187/20 |
| 5,167,400 | A | * | 12/1992 | Gazel-Anthoine | 254/275 |
| 5,324,007 | A | * | 6/1994 | Freneix | 254/300 |
| 5,435,209 | A | | 7/1995 | Wittur | |
| 5,631,511 | A | * | 5/1997 | Schulmann et al. | 310/83 |
| 5,851,163 | A | | 12/1998 | Kawase et al. | |
| 5,944,150 | A | * | 8/1999 | Hikari | 188/161 |

FOREIGN PATENT DOCUMENTS

| | | | | |
|---|---|---|---|---|
| DK | 23461 | * | 8/1918 | 254/363 |
| EP | 0 834 463 A1 | | 4/1998 | |
| GB | 2064067 | * | 6/1981 | 254/363 |
| JP | 63-3823 | | 1/1988 | |
| WO | WO 95/00432 | | 1/1995 | |

* cited by examiner

*Primary Examiner*—Thomas J. Brahan
(74) *Attorney, Agent, or Firm*—Akin Gump Strauss Hauer & Feld, L.L.P.

(57) ABSTRACT

A driving apparatus for an elevator includes rotary elements disposed in such a manner as to be in contact with a circumferential surface of an input shaft adapted to be rotationally driven by an electric motor device so as to rotate as the input shaft rotates, a cylindrical element disposed in such a manner as to be in contact with the rotary elements on an inner circumferential surface thereof so as to rotate as the rotary elements rotate, and a sheave provided on an outer circumferential side of the cylindrical element and configured so as to be wound therearound with ropes for lifting up and/or down a moving cage of the elevator. A brake device is disposed in a radial direction of the sheave for braking a brake disc constructed so as to extend in the radial directions and secured to the sheave.

12 Claims, 3 Drawing Sheets

DRIVING APPARATUS FOR ELEVATOR

BACKGROUND OF THE INVENTION

The present invention relates to a driving apparatus for lifting up and/or down a moving cage of an elevator.

Referring to FIG. 4, a conventional driving apparatus for use in an elevator will be described which is disclosed in JP-B-63-3823. This driving apparatus 1 has a speed reducer 2, an electric motor device 3 for rotationally driving an input shaft 2*b* of the speed reducer 2, a sheave 4 adapted to be rotationally driven by an output shaft 2*d* of the speed reducer 2, an ordinary electromagnetic brake device 8 mounted on the electric motor device 3 for braking the input shaft 2*b*, and an emergency electromagnetic brake device 9 mounted on the output shaft 2*d* for braking the output shaft 2*d*. When the input shaft 2*b* of the speed reducer 2 is rotationally driven by the electric motor device 3, the output shaft 2*d* rotates via a supporting shaft f and a supporting plate 2*e* at a slower speed resulting when the rotation of the input shaft is frictionally transmitted via a roller 2*c*, a roller 2*g* and a friction element 2*h*, and then the sheave 4 is rotationally driven. When the transmission of the power of the input shaft becomes impossible due to the friction generated by the roller 2*c* and the like, upon detection of this abnormal state, the emergency electromagnetic brake device 9 is activated and the brakes are applied to the output shaft 2*d*, whereby the sheave 4 is brought to a halt.

According to the driving apparatus for an elevator as described above, however, the emergency electromagnetic brake device 9 is secured to the output shaft 2*d* and is provided so as to extend in the direction of the input shaft, this making the brake device larger. In addition, the ordinary electromagnetic brake device 8 is also provided so as to extend in the input shaft direction. Thus, the entirety of the driving apparatus had to be made thicker with respect to the axial direction of the input shaft. This in turn serves to make larger an elevator room in a building where the driving apparatus and the like are placed. Additionally, the supporting shaft 2*f* which is coupled to the output shaft 2*d* is of a cantilever type in which the output shaft is supported on the supporting plate 2*e*, and this facilitates the deformation through deflection, which is not good in terms of the rotation transmission capability.

BRIEF SUMMARY OF THE INVENTION

An object of the invention is to provide a driving apparatus for an elevator in which not only can a brake device be miniaturized but also the entirety of the driving apparatus itself can be made thinner in a direction of an input shaft.

With a view to attaining the above object, there is provided a driving apparatus for an elevator comprising an electric motor device, an input shaft adapted to be rotationally driven by the electric motor device, rotary elements disposed in such a manner as to be in contact with a circumferential surface of the input shaft so as to rotate as the input shaft rotates, supporting members fixed in such a manner as to rotatably support the rotary elements, a cylindrical element disposed in such a manner as to be in contact with the rotary elements on an inner circumferential surface thereof so as to rotate as the rotary elements rotate, a sheave provided on an outer circumferential side of the cylindrical element, adapted to rotate together with the cylindrical element and configured so as to be wound therearound with ropes for lifting up and/or down a moving cage of the elevator, and a brake device disposed in a radial direction of the sheave for braking a brake disc constructed so as to extend in the radial direction and secured to the sheave.

According to the invention, the rotation of the input shaft is transferred through frictional transmission to the cylindrical element and the sheave via the rotary elements to thereby rotate the cylindrical element and the sheave, but the rotary elements, cylindrical element and sheave are provided in diametrical directions of the input shaft and the brake device including the brake disc is provided in radial directions of the sheave, whereby the entirety of the brake apparatus can be made thinner in the direction of the input shaft. In addition, the brake disc is located radially outwardly of the sheave and this increases the radius thereof, whereby with the brake disc so constructed, in order to obtain a certain magnitude of braking force there is needed only a smaller magnitude of braking force than one needed with a brake disc other than the brake disc according to the invention. This helps miniaturize the brake apparatus. Note that in a case where there are provided a plurality of rotary elements, the plurality of rotary elements are disposed in such a manner as to be in internal contact with the inner circumferential surface of the cylindrical element. In addition, the brake device can be installed such that it extends from the supporting member of the driving apparatus.

In addition, there is provided a driving apparatus for an elevator, wherein the rotary elements are provided in such a manner as to rotate about intermediate shafts, and wherein the intermediate shafts are rotatably supported by the supporting members at ends thereof. According to this construction, the rotary elements are supported in a stable fashion and they can rotate in a smooth fashion, whereby rotations from the electric motor device are transferred as far as the sheave in a smooth fashion, thereby making it possible to improve the rotational transfer capability.

Furthermore, there is provided a driving apparatus for an elevator, wherein there are provided a plurality of the brake devices. Since the brake device is disposed in the radial direction of the sheave, it is possible to set a plurality of, for instance, two brake devices, whereby if the same magnitude of brake torque as that which would be obtained with a single brake device is tried to be obtained with the entirety of the brake disc, the respective brake devices can further be miniaturized. In addition, one of the two brake devices may be adapted to be activated for operation at normal times and the other to be activated for operation for emergency.

The present disclosure relates to the subject matter contained in Japanese patent application No. Hei. 11-154508 (filed on Jun. 2, 1999), which is expressly incorporated herein by reference in its entirety.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
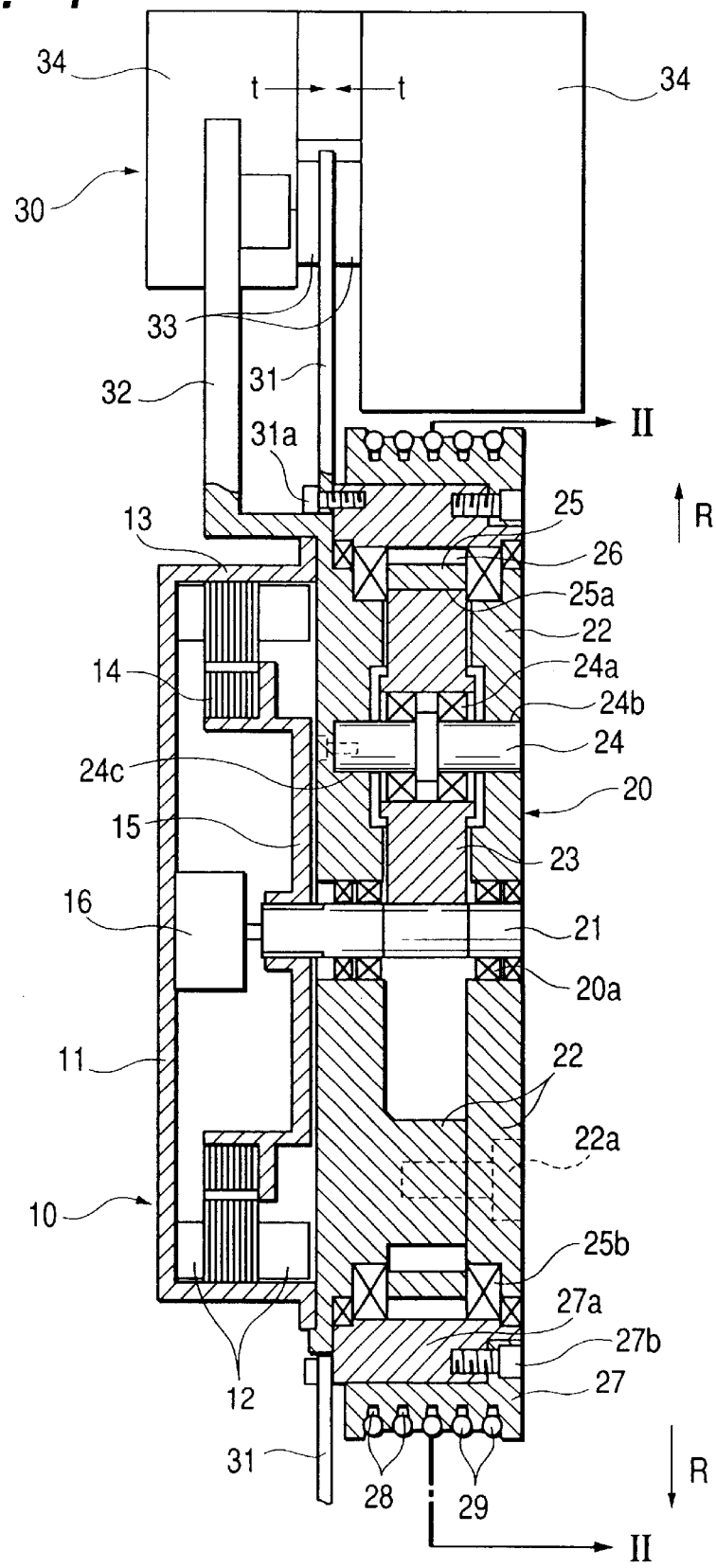
FIG. 1 is a side cross-sectional view of a driving apparatus for an elevator showing a mode for carrying out the invention.

Referring to the accompanying drawings, a mode for carrying out the invention will be described below. FIG. 1 is a side cross-sectional view of a driving apparatus for an. elevator according the mode for carrying out the invention, FIG. 2 is a cross-sectional view taken along the line II—II in FIG. 1, and FIG. 3 is a block diagram of a control system for the driving apparatus shown in FIG. 1.

As shown in FIG. 1, the present driving apparatus for an elevator comprises an electric motor device 10, a speed change gear 20 for changing for transfer the rotational speed of an input shaft 21 that is rotationally driven by the electric motor device 10, and a brake device 30.

The electric motor device 10 comprises coils 12, a stator 13 held between the coils 12, a rotor 14, a rotor plate 15 fixed to the rotor 14 and also fixed to the input shaft 21 at a central portion thereof for rotation and an encoder 16 coupled to the input shaft 21 for detection of the number of revolutions thereof, which are all disposed within a housing 11 of the electric motor device 10. The housing 11 is mounted on and fixed to supporting members 22 of the speed change gear 20. The electric motor device 10 is controlled by means of a control part 41 shown in FIG. 3 with respect to the excitation of the coils 12 for controlling the 5 driving thereof.

Figure 2:
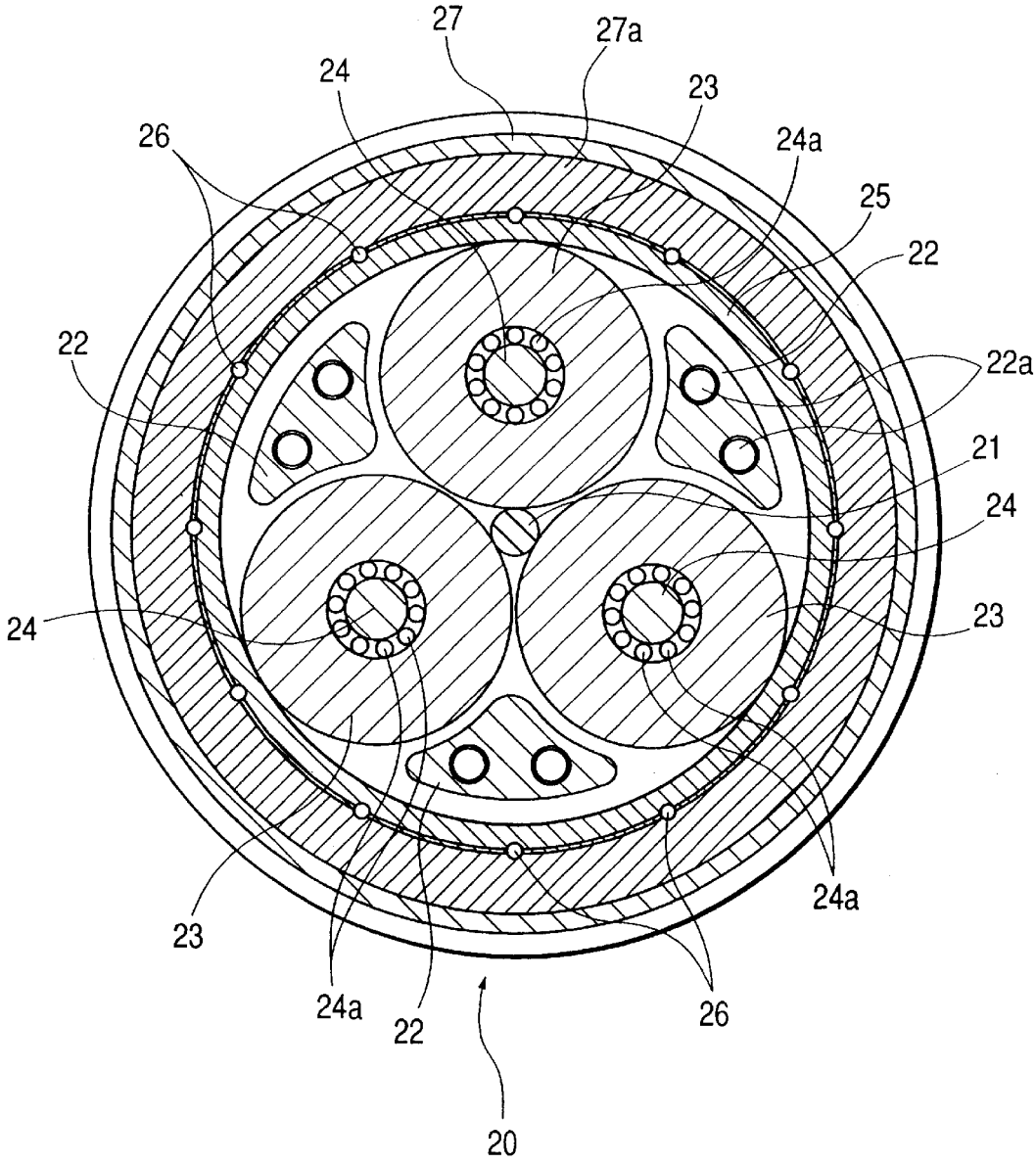
FIG. 2 is a cross-sectional view taken along the line II—II in FIG. 1.
Figure 3:
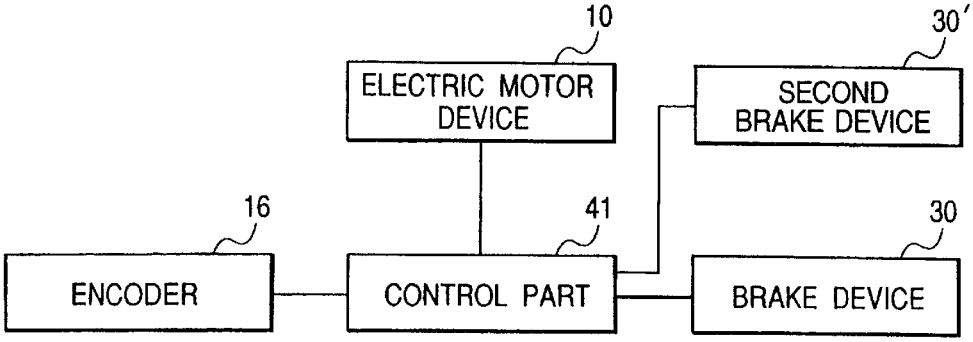
FIG. 3 is a block diagram showing a control system for the driving apparatus shown in FIG. 1.

In addition, as shown in FIGS. 1 and 2, the speed change gear 20 comprises the input shaft 21 rotatably supported by the supporting members 22 via a bearing 20*a*, a plurality of frictional rotary elements 23 disposed in such a manner as to be in contact with an inner circumferential surface of the input shaft 21 so as to rotationally be driven through frictional transmission, a cylindrical element 25 disposed such that the plurality of frictional rotary elements 23 are, respectively, in contact with an inner circumferential surface 25*a* thereof so as to rotationally be driven through frictional transmission and supported rotatably by means of a bearing 25*b*, and a sheave 27 to which an inner circumferential portion 27*a* adapted to be rotated together with the cylindrical element 25 via a plurality of pins 26 is secured with fastening bolts 27*b* and which has grooves 28 formed in an outer circumferential surface of the sheave 27 for ropes 29 to be wound around the sheave 27 in the grooves 28.

When the rotation of the input shaft 21 is reduced in speed and is then transferred to the cylindrical element 25 and the sheave 27, they rotate concentrically relative to the input shaft 21. The ropes 29 are connected at ends to a moving cage of an elevator (not shown) and a counterweight (not shown) and move vertically so as to lift up and/or down the moving cage. In addition, the supporting members 22 are provided in a divided fashion, and are, as shown in FIGS. 1 and 2, fixed integrally with bolts 22*a*. On top of that, the supporting members 22*a* are also fixed to an exterior member (not shown) such as an elevator room or the like, which allows the driving apparatus to be fixed to and disposed in the elevator room or the like.

The plurality of frictional rotary elements 23 are rotatably supported at central portions thereof by the intermediate shafts 24 via bearings 24*a*. The cylindrical intermediate shaft 24 is, as shown in FIG. 1, supported by the supporting member 22 at ends 24*b*, 24*c* thereof, and this tends to reduce the deformation such as deflection of the intermediate shaft, whereby the transfer of rotations of the input shaft 21 is stabilized and the rotation transfer capability is preferably improved.

The brake device 30 comprises a brake disc 31 secured to a 20 side of the inner circumferential portion 27*a* of the sheave 27 with fastening bolts 31*a*, constructed so as to extend in a radial direction R of the sheave 27 and disposed concentrically with the input shaft 21, brake pads 33 disposed on both sides of the brake disc 31 and constructed so as to be activated by virtue of a pressure applied from a brake main body 34, and a supporting arm 32 extending in a radial direction R from the supporting member 22 for supporting the brake main body 34. A conventional structure may be used for the brake main body 34 for applying a braking force to the brake disc 31 via the brake pads 33 in which for example, an electromagnet is used to activate the brake pads 33.

Next, referring to FIG. 3, the control system for the driving 10 apparatus according to the mode for carrying out the invention will be described below. This control system has the control part 41 connected, respectively, to the electric motor device 10, the encoder 16 for the electric motor device 10 and the brake device 30. The driving apparatus can drive the moving cage of the elevator while controlling the same through a predetermined sequence by controlling by the control part 41 the excitation of the coils 12 of the electric motor device 10 and the electromagnet of the brake device 30. In addition, the electric motor device 10 and the brake device 30 are controlled based on information inputted from the encoder 16 on the number of revolution of the electric motor device 10.

The control of driving the moving cage of the elevator by the driving apparatus shown in FIGS. 1 to 3 will be described. First, when the electric motor device 10 is activated by a signal from the control part 41 and the rotor 14 rotates, the input shaft 21 then rotating, the plurality of frictional rotary elements 23 which are respectively in contact with the circumferential surface of the input shaft 21 rotate about the intermediate shafts 24 through frictional transmission. Then, the cylindrical element 25 with which the plurality of frictional rotary elements 23 are in internal contact rotates through frictional transmission, and at the same time the sheave 27 coupled to the 10 cylindrical element 25 via the plurality of pins 26 rotates together with the inner circumferential portion 27*a* thereof. Then, the ropes 29 wound around the sheave 27 in the grooves 28 formed in the outer circumferential surface thereof are driven to move vertically, whereby the moving cage of the elevator moves vertically. Note that the rotation of the input shaft 21 is reduced in speed using a predetermined reduction ratio for transfer, whereby the sheave 27 is allowed to rotate at a certain rotational speed.

On the other hand, in order to stop the moving cage of the 20 elevator, the electric motor device 10 is stopped by a signal from the control part 41, and at the same time as this happens, the brake device 30 is activated. Through the operation of this brake device 30, the brake main body 34 urges the brake pads 33 in directions indicated by arrows t in FIG. 1 so as to be applied to both sides of the brake disc 31 to thereby stop the rotation of the brake disc 31, whereby the sheave 27 rotating together with the brake disc 31 stops. Then, the ropes stop their movements, whereby the moving cage of the elevator is stopped.

In operation of the brake device 30 constructed as described above, since the brake disc 31 is provided so as to extend in the radial directions R of the sheave 27, the radius of the brake disc 31 becomes large at the position of the brake pads 33, and in a case where a certain magnitude of brake torque is tried to be obtained with this brake disc, a braking force needing to be applied to the brake disc from the brake main body 34 via the brake pads 33 may be smaller than a braking force needing to be applied to a brake disc other than the brake disc according to the invention. Due to this, the capacity of the brake main body 34 may be small, this helping miniaturize the entirety of brake device 30.

Figure 4:
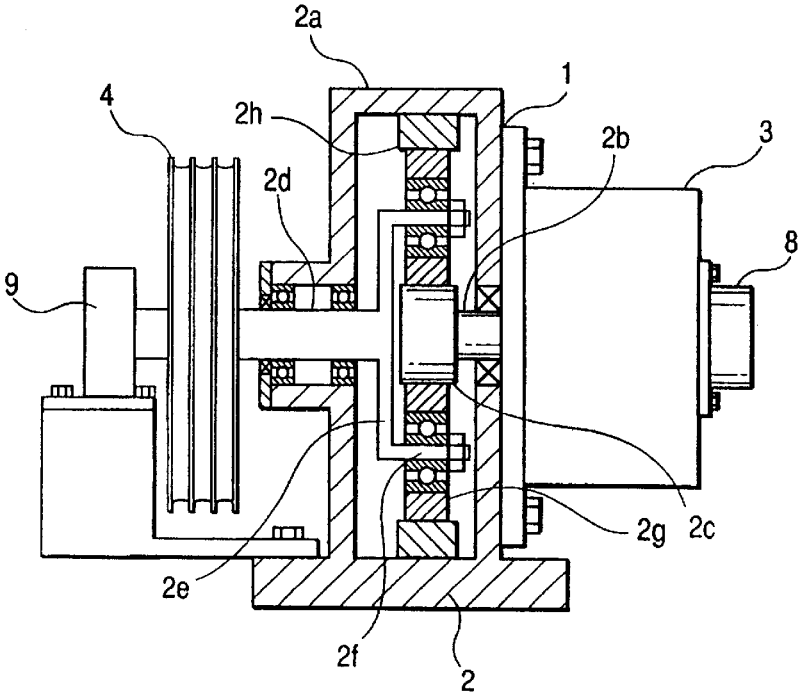
FIG. 4 (Prior Art)
FIG. 4 is a vertical cross-sectional view showing a conventional driving apparatus for an elevator.

In addition, in the speed change gear 20, the plurality of frictional rotary elements 23 are disposed around the circumferential surface of the input shaft 21, the cylindrical element 25 contains those frictional rotary elements 23 such that the frictional rotary elements 23 come into internal contact with the inner circumferential surface of the cylindrical element 25, the sheave 27 is disposed on the outer circumferential side of the cylindrical element 25 so that the sheave 27 rotates together with the cylindrical element 25, and as a whole, the speed change gear 20 is constructed so as to extend in the radial directions R of the sheave 27 which are normal to the input shaft 21. Thus, according to this construction, the speed change gear 20 can be made thinner in the axial direction of the input shaft 21 than, for example, the conventional driving apparatus shown in FIG. 4. Moreover, since the brake device 30 is situated radially outwardly of the sheave 27 which is the radial direction R of the sheave 27, the entirety of the driving apparatus for an elevator can be constructed thinner, thereby making it possible to achieve the miniaturization of the driving apparatus, whereby the elevator room in a building where the elevator is provided can be made smaller and space in the building can be saved preferably.

Referring to FIG. 1, moreover, since the first brake device 30 is situated radially outwardly of the sheave 27 (radial direction R), while being kept thinner in the direction of the input shaft 21, there may be provided a plurality of, for example, two brake devices including the first brake device 30 and a second brake device 36'. The second brake device 30' is comprised of a second support arm 32', second brake pads 33' and a second brake main body 34'. With two brake devices 30 and 30' being provided, the capacity of the respective brake devices 30 and 30' may be half the capacity if there is provided a single first brake device 30, whereby the brake device can be miniaturized further. In addition, one of the two brake devices 30 or 30' maybe used as an ordinary brake device, while the other may be used as an emergency one. In this case, for instance, if the respective members in the speed change gear get worn, the rotation of the input shaft 21 being unable to be normally transferred as far as the sheave 27, the detection of this abnormal state can activate the emergency brake device 30 or 30', so as to stop the moving cage of the elevator.

Thus, while the mode for carrying out the invention has been described heretofore, the invention is not limited thereto, and the invention may be modified variously without departing from the technical concept of the invention. For example, the cylindrical element and the sheave may be formed integrally, and the ropes may be wound around the outer circumferential surface of the cylindrical element. In addition, it goes without saying that there may be provided two or more brake devices.

According to the driving apparatus for an elevator of the 15 invention, not only can the brake device be miniaturized but also the entirety of the driving apparatus can be constructed thinner in the input shaft direction than conventionally.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A driving apparatus for an elevator comprising:

an electric motor device having a rotary plate extending radially, and a rotor fixed to an outer circumference of the rotary plate;

an input shaft fixed to a central portion of the rotary plate, and adapted to be rotationally driven by said electric motor device;

rotary elements, each contacting a circumferential surface of said input shaft such that the rotary elements rotate as said input shaft rotates;

a supporting member adjacent to the rotary plate, and rotatably supporting said rotary elements;

a cylindrical element having an inner circumferential surface contacting said rotary elements to rotate as said rotary elements rotate;

a sheave provided on an outer circumferential side of said cylindrical element to rotate together with said cylindrical element, and supported on the supporting member; and a brake disc secured to said sheave in a radial direction outside of said sheave.

2. A driving apparatus for an elevator as set forth in claim 1, wherein said sheave is configured to be wound therearound with ropes for lifting a moving cage of said elevator up and down.

3. A driving apparatus for an elevator as set forth in claim 1, further comprising:

a first brake main body disposed radially outwardly of said sheave, said first brake main body forming a brake device in cooperation with said brake disc.

4. A driving apparatus for an elevator as set forth in claim 1, further comprising:

intermediate shafts that rotatably support said rotary elements, respectively, and that are supported by said supporting member.

5. A driving apparatus for an elevator as set forth in claim 4, wherein each of said intermediate shafts has axial ends supported by said supporting member.

6. A driving apparatus for an elevator as set forth in claim 1, further comprising:

at least one second brake including a second brake main body disposed radially outwardly of said sheave, a first brake main body and said at least one second brake main body forming a plurality of brake devices in cooperation with said brake disc.

7. A driving apparatus for an elevator as set forth in claim 1, wherein said supporting member includes a first part and a second part fixed to said first part.

8. A driving apparatus for an elevator as set forth in claim 7, wherein said rotary elements are accommodated in a space defined between said first and second parts.

9. A driving apparatus for an elevator as set forth in claim 1, wherein said rotary elements are rotatably supported through intermediate shafts by said supporting member.

10. A driving apparatus for an elevator as set forth in claim 1, wherein said rotary elements, said cylindrical element and said sheave are arranged on and along the same imaginary plane.

11. A driving apparatus for an elevator as set forth in claim 1, wherein rotational torque is transmitted from said circumferential surface of said input shaft to outer circumferential surfaces of said rotary elements through friction therebetween.

12. A driving apparatus for an elevator as set forth in claim 1, wherein rotational torque is transmitted from outer circumferential surfaces of said rotary elements to said inner circumferential surface of said cylindrical element through friction.

* * * * *